US010986878B2

(12) United States Patent
Xu

(10) Patent No.: US 10,986,878 B2
(45) Date of Patent: Apr. 27, 2021

(54) COMPOSITE WATERPROOF BREATHABLE SOCK WITH TWO-WAY EXTENSIBLE PROPERTIES

(71) Applicant: Shanghai Uniwise International Co. Ltd., Shanghai (CN)

(72) Inventor: Qian Xu, Shanghai (CN)

(73) Assignee: Shanghai Uniwise International Co. Ltd., Shanghai (CN)

( * ) Notice: Subject to any disclaimer, the term of this patent is extended or adjusted under 35 U.S.C. 154(b) by 127 days.

(21) Appl. No.: 14/504,156

(22) Filed: Oct. 1, 2014

(65) Prior Publication Data

US 2016/0095381 A1 Apr. 7, 2016

(51) Int. Cl.
*A41B 11/00* (2006.01)

(52) U.S. Cl.
CPC ..... *A41B 11/005* (2013.01); *A41B 2400/22* (2013.01)

(58) Field of Classification Search
CPC ... D04B 21/18; A41B 11/005; A41B 2400/22; D10B 2403/02; A41D 9/0006; A41D 13/0005; B32B 5/026; B63C 11/04
USPC ..... 2/240, 241; 36/4, 7.1 R, 7.3, 9 R
See application file for complete search history.

(56) References Cited

U.S. PATENT DOCUMENTS 3,793,851 A * 2/1974 Thorneburg ..... D04B 1/02 66/185
3,831,360 A * 8/1974 Horvath ..... D02G 1/0246 19/0.64
4,443,511 A * 4/1984 Worden ..... B32B 5/18 428/198
4,967,494 A * 11/1990 Johnson ..... A41B 11/005 2/239
5,244,716 A * 9/1993 Thornton ..... A41B 11/005 156/183
5,483,703 A 1/1996 Williams
5,518,801 A * 5/1996 Chappell ..... A61F 13/15707 428/152

(Continued)

OTHER PUBLICATIONS

Combined Search and Examination Report dated Nov. 22, 2013 in UK Application GB1317866.0.

(Continued)

*Primary Examiner* — Nathan E Durham
*Assistant Examiner* — Abby M Spatz
(74) *Attorney, Agent, or Firm* — Pearne & Gordon LLP

(57) ABSTRACT

A composite waterproof breathable sock with two-way extensible properties, wherein each sock is formed by lamination of an outer layer, an inner layer and an intermediate waterproof and breathable sock-like film component on a one-step forming mould. The outer layer, or both the outer and inner layers, is/are knitted by deploying fine twisted elastic yarns consistently into all the knitting courses of the main body for each such layer, so as to make the composite sock therefore extensible in both weft X and warp Y directions after lamination of the layer(s) to the waterproof film component such that the composite sock will be recoverable uniformly after stretching to a relaxed conformation. The composite sock can be sewn with a water seal kit inside the cuff band, wherein the cuff band is extended from the outer component of the sock. The in-cuff seal kit can be constructed by a sew-in waterproof polyurethane elastic fabric in round shape.

9 Claims, 6 Drawing Sheets

(56) References Cited

U.S. PATENT DOCUMENTS

| | | | | |
|---|---|---|---|---|
| 5,682,616 | A * | 11/1997 | Pisano | A41B 11/00 2/16 |
| 6,139,929 | A | 10/2000 | Hayton et al. | |
| 6,807,683 | B2 * | 10/2004 | Williams | A41B 11/00 156/212 |
| 2005/0081571 | A1 * | 4/2005 | Bhatnagar | D03D 1/0052 66/202 |
| 2016/0332711 | A1 * | 11/2016 | Harrington | A41D 13/0005 |

OTHER PUBLICATIONS

Examination Report dated May 6, 2014 in UK Application GB1317866.0.

* cited by examiner

COMPOSITE WATERPROOF BREATHABLE SOCK WITH TWO-WAY EXTENSIBLE PROPERTIES

FIELD OF THE INVENTION

The invention relates to a kind of waterproof breathable sock for outdoor uses, and specifically relates to a kind of waterproof composite socks which have two-way extensible properties, such that they therefore can be stretched circumferentially and longitudinally.

BACKGROUND

It is desirable for outdoor garments to be waterproof and breathable, in order to provide protection in arduous environments whilst keeping the wearing comfortable. Along with the commercialization of the waterproof and breathable film technology by W. L. Gore, such dual function performance was rapidly developed in the field of outdoor sportswear. Also with the protective demand extending to outdoor sports accessories, the technology was also applied to outdoor socks where people need to protect their feet, keeping them dry and comfortable in outdoor sports and related activities.

A well known waterproof breathable sock was developed by W. L. Gore. This sock is assembled by a cut and sew method using a waterproof breathable fabric laminate (as shown in FIG. 1). Although the sock, or bootie, is functionally performed, it is not as stretchable and close fitting as a normal knit outdoor sock. It therefore lacks the comfort performance that a sock should have for outdoor activities, due to the non-stretchable laminate and seam tapes laminated along its stitching line.

In order to overcome said problem, the document U.S. Pat. No. 5,483,703 provides a sandwiching lamination technology, wherein the sock is constructed by an inner sock, an outer sock, and an intermediate barrier, wherein the intermediate barrier is a waterproof but moisture vapour permeable film.

As in FIG. 2, the outer component 3 is a seamless knitted sock, normally using abrasion resistant, easy to drip dry nylon or polyester yarns. The inner sock component 5 uses such performance materials as Merino wool or Thermolite or Coolmax yarns, the last two being registered trademark of Invista. The waterproof breathable barrier 4 is available in the market e.g. the microporous or hydrophilic membranes such as Gore-Tex film by W. L. Gore or Porelle film made by PIL Membranes Ltd. The adhesion of the three layers can be made using polyamide or nylon (PA), polyester (PES) or thermoplastic polyurethane (TPU) hot melt adhesive systems in powder spreading technology. By using the sandwiching mould 6, the three components are bonded together whilst the waterproof breathable film is sandwiched in the waterproof composite sock.

Another prior art reference, U.S. Pat. No. 5,244,716, addressed discrete dotting adhesive technology. As shown in FIG. 3, the three layers are bonded by discrete adhesive dots. To realize the construction, the elastic inner and outer fabrics should be stretched to the extension of the non-stretchable waterproof breathable film size then laminated at that position. In this way, the non-stretchable waterproof breathable film will have a corrugated structure as shown in FIG. 2A, after lamination. The corrugated structure gives the non-stretchable film a certain range of extensible properties, so as to give the composite fabric a certain elasticity that the aforementioned laminate fabric used for a cut and sew bootie does not have.

A further reference, U.S. Pat. No. 6,139,929, describes a composition and forming technology that further improved upon the embodiment of the above technology for waterproof composite socks. As in FIG. 4, this technology adopted a kind of wide former 8, specifically at least 150% wider than the relaxed size of the sock components used. Accordingly as illustrated in FIG. 4B, the sock component is knitted with weft course deployed, circumferentially laid in elastic threads 9, from toe to the cuff along the sock tube, which can make the finished composite sock capable of at least 50% lateral recovery after the laminated structure is removed from the wide former 8. Due to (i.e. to facilitate) the lateral recovery of the resulting structure, the non-stretchable waterproof film component sandwiched in between is made corrugated in the longitudinal direction along the sock tube, as shown in FIG. 4A, therefore it could be extensible circumferentially when the composite sock is stretched laterally.

However, even though the composite sock in this technology is extensible laterally by adopting the above said laid-in elastic thread 9, the sock does not have an ideal elasticity, extensibility, along the sock length (longitudinal) direction. Due to the above shortcoming, the composite sock by this technology has to insert a waterproof breathable film component at a pre-set foot size (as shown in FIG. 4, the length A), and as a result, the finished sock has very little size flexibility compared to a normal sock. In reality, foot sizes vary a lot from person to person, therefore the composite sock made by the above said technology cannot be made to fit a range of foot sizes as would a conventional sock due to its length flexibility. Nor do such socks meet the durability demand in outdoor sports activities when the non-stretchable waterproof breathable film component is easily rubbed through by the toes at the toe part if the sock is tightly fitting.

In addition, none of the above documents gives a solution to the problem that water comes over into the top of the waterproof socks during wading activity. The document U.S. Pat. No. 6,807,683 provides a simple method to stop water from entering the sock from the top. It extends the waterproof film barrier upwards to exceed the length of inner sock, whilst extending the elastic cuff part of the outer sock further up over the waterproof barrier component. By this, the elastic cuff band of the outer sock presses the elongated part of the waterproof film tightly over the leg calf so as to functionalize it as a round seal to stop the water from splashing in.

However, this technology has two shortcomings. On one hand, the adhesive powders spread on the interior surface of the waterproof film, which are applied for bonding to the inner sock, are easily scrubbed off and fall over to the skin. On the other hand, the hydrophilic type of waterproof film touching directly to the skin has a clammy feeling when it gets wet. Both side effects cause the wearer an uncomfortable outdoor experience.

The present invention provides a one package solution to improve at least some of the technical shortcomings of the prior technologies explained above. Besides having waterproof and breathable performance, the waterproof composite socks made by the present technology are also stretchable in all directions (e.g. both longitudinally and laterally) to fit close to the feet both circumferentially and longitudinally, whilst having size flexibility to accommodate a range of foot sizes for a particular sock construction. In addition, this invention claims a new and practical way to stop water from flowing into the waterproof socks. The present invention not only improves the comfort of the composite socks, but also extends much longer the use life of the waterproof socks. In production point of view, the forming mould adopted in this invention is much smaller, compared to the one adopted in the document U.S. Pat. No. 6,139,929, so as to raise the productivity significantly.

SUMMARY OF THE INVENTION

The invention describes a composite waterproof breathable sock with two-way extensible properties, wherein each sock is formed by lamination of an outer layer, an inner layer and an intermediate waterproof and breathable film on a one-step forming mould, wherein the outer layer, or both the outer and inner layers, is/are knitted by deploying fine twisted elastic yarns consistently into all the knitting courses of the main body. The elastic yarns preferably are made of spandex. By adopting this material composition and using the specialized forming mould, the composite sock obtains longitudinal extensibility especially along the sock bottom, and therefore offers size flexibility to the users across a wide range of sizes, whereas normally only 4 sizes can be accommodated by waterproof composite socks. This invention eliminates the uncomfortable feeling, either too tight or too loose (size up), and significantly reduces the possibility of scrubbing the waterproof film through at the toe part, which happens sometimes on the composite socks made by the prior technology.

In an embodiment, the twisted elastic yarns added in the outer layer are 350 twists per meter.;

In a further embodiment, the ratio of the main body yarns to the added-in twisted elastic yarns is 75:25;

In still a further embodiment, the outer layer, or both the outer and the inner layers, is/are knitted on the single-cylinder 4.0 inches jacquard hosiery machine;

In still a further embodiment, the adhesives used for lamination between the outer layer, the inner layer, and the intermediate waterproof breathable film are heat activated thermoplastic polyurethane (TPU) material;

Furthermore, the intermediate waterproof breathable film can be made up into a sock-like component in advance, with TPU adhesive spread on both interior and exterior surfaces in discrete dots or powder before lamination. The said sock-like component should be larger than the relaxed inner and outer sock layers, so as to shrink with the inner and outer layers after lamination off the mould back to the regular size. By this arrangement, the waterproof breathable film sandwiched in between the outer and inner layers has a corrugated structure in both wefts X and warp Y directions, so it will be able to be stretched circumferentially and longitudinally.

Furthermore, the forming mould for the one-step, heat press lamination can be a sock-like plate, which has the same size as the said sock-like film component said above;

An exemplary assembly method is, firstly to pull the outer layer over the larger forming mould described above, secondly to slip the sock-like film component over outside the outer layer on the mould, thirdly to pull the inner layer directly over outside the film component, lastly to heat press the aforementioned layers and film together on the forming mould to produce a laminated composite sock that can be removed from the forming mould in a single removal step.

Preferably, the composite sock has a cuff band with a water seal kit inside, wherein the cuff band is extended from the outer layer of the sock, and wherein the in-cuff seal kit is constructed of two-way stretchable waterproof polyurethane fabric (e.g. highly elastic eco fabric for swimwear);

Furthermore, the two-way stretchable PU fabric is round sewn inside cuff band;

The height, along the sock longitude, of said round sewn PU elastic fabric is preferably equal to or longer than 2 cm. By the inventor's internal experiments, the in-cuff water block kit for the type of waterproof sock is only functional to stop the water flowing in when the height of water block material is at or above a certain level;

In a further preferred embodiment, the height of said round shape polyurethane elastic fabric is 5 cm.

The invention further describes a method of making a waterproof breathable sock, wherein the intermediate waterproof breathable film is made up into a sock-like film in advance, with thermoplastic polytarethanc (TPU) adhesive spread on both interior and exterior surfaces in discrete dots or powder before lamination, the said sock-like film being larger than the inner and outer layers in their relaxed conformations, so as to shrink with the inner and outer layers (back to their relaxed size) after lamination thereto and removal of the resulting composite sock from the mould.

The invention still further describes an assembly method of making a waterproof composite sock with two-way extensible properties using a one-step forming mould, wherein the mould is a sock-like plate, in the same size as a sock-like film component, being used for a heat press lamination process (sandwiching), said assembly method being firstly to pull an outer sock layer over the forming mould which is larger than the said mould, secondly to slip the sock-like film over outside the outer sock layer on the mould, thirdly to pull an inner sock layer directly over outside the film component, the outer sock layer or both the outer sock layer and the inner sock layer being knitted by deploying fine twisted elastic yarns consistently into all the knitting courses of the respective outer/inner sock layers so that the fine twisted elastic yarns are knitted with yarns of the main body of the outer/inner sock layer(s) and lastly to heat press the set of layers and the film together to produce a laminated composite sock that can be removed as a composite from the forming mould in a single removal step.

Figure 1:
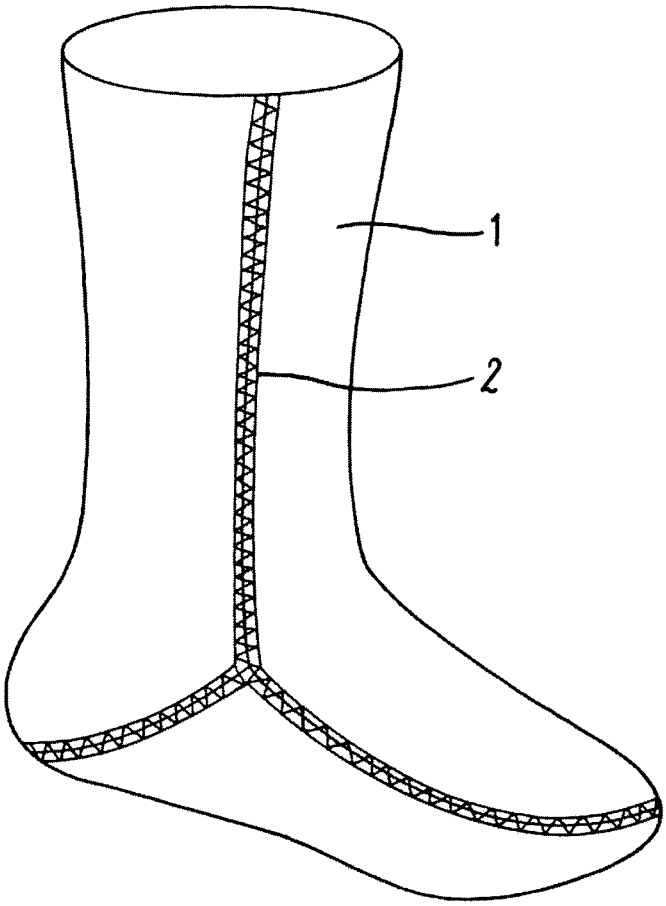
Fig. 1 Prior Art
FIG. 1 is a schematic perspective view of the waterproof bootie by cut and sew fabric laminate using the Gore-Tex technology.
Figures 2, 2A:
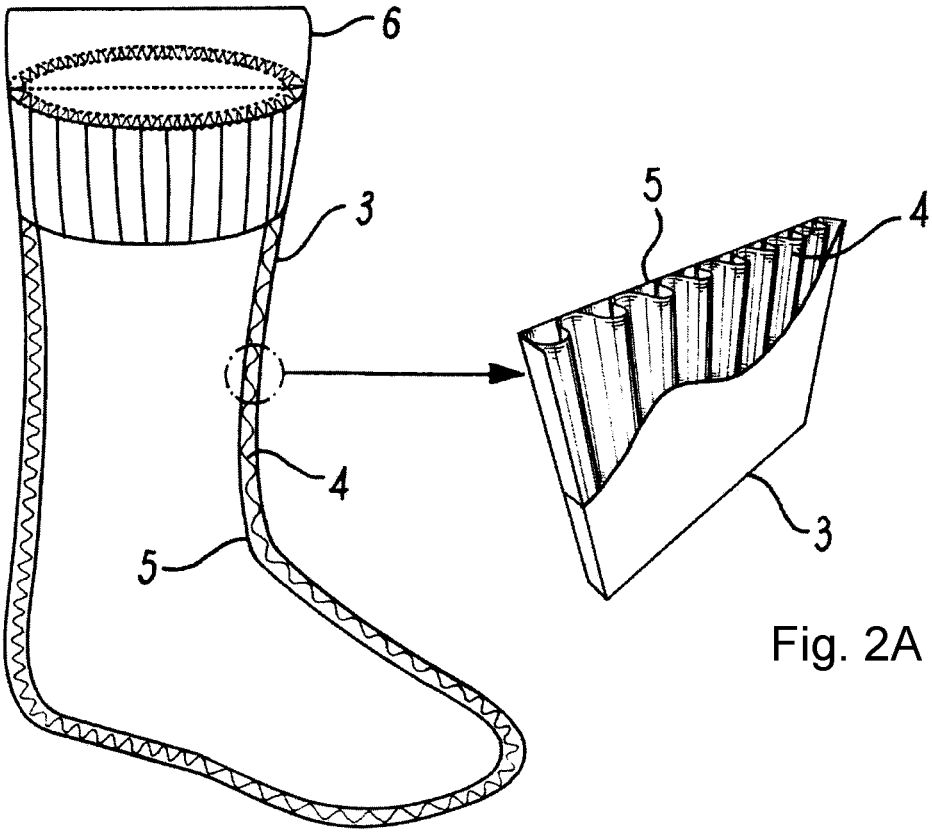
Fig. 2 Prior Art
FIG. 2 is a cross sectional view of the construction of a waterproof composite sock.
FIG. 2A is a cross sectional view of the corrugated structure for the intermediate waterproof breathable film for the sock construction illustrated in FIG. 2.
Figure 3:
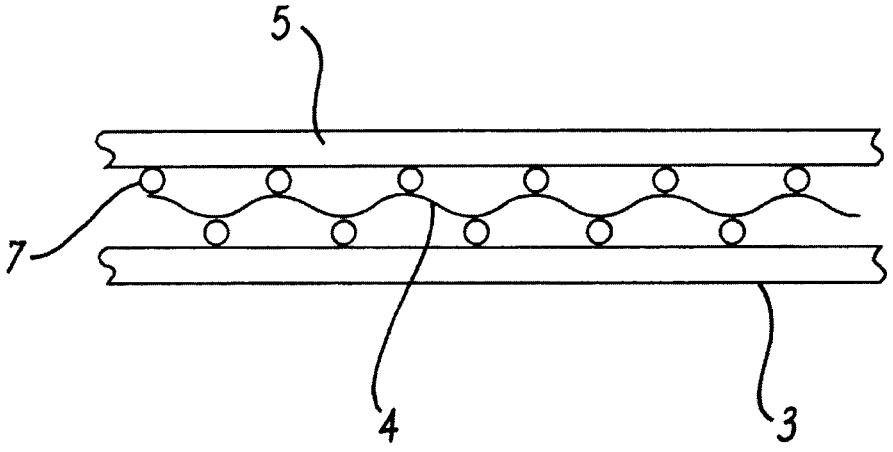
Fig. 3 Prior Art
FIG. 3 is a cross sectional view of a configuration of a composite sock exhibiting three-ply lamination using the discrete adhesive dots.
Figures 4, 4A, 4B:
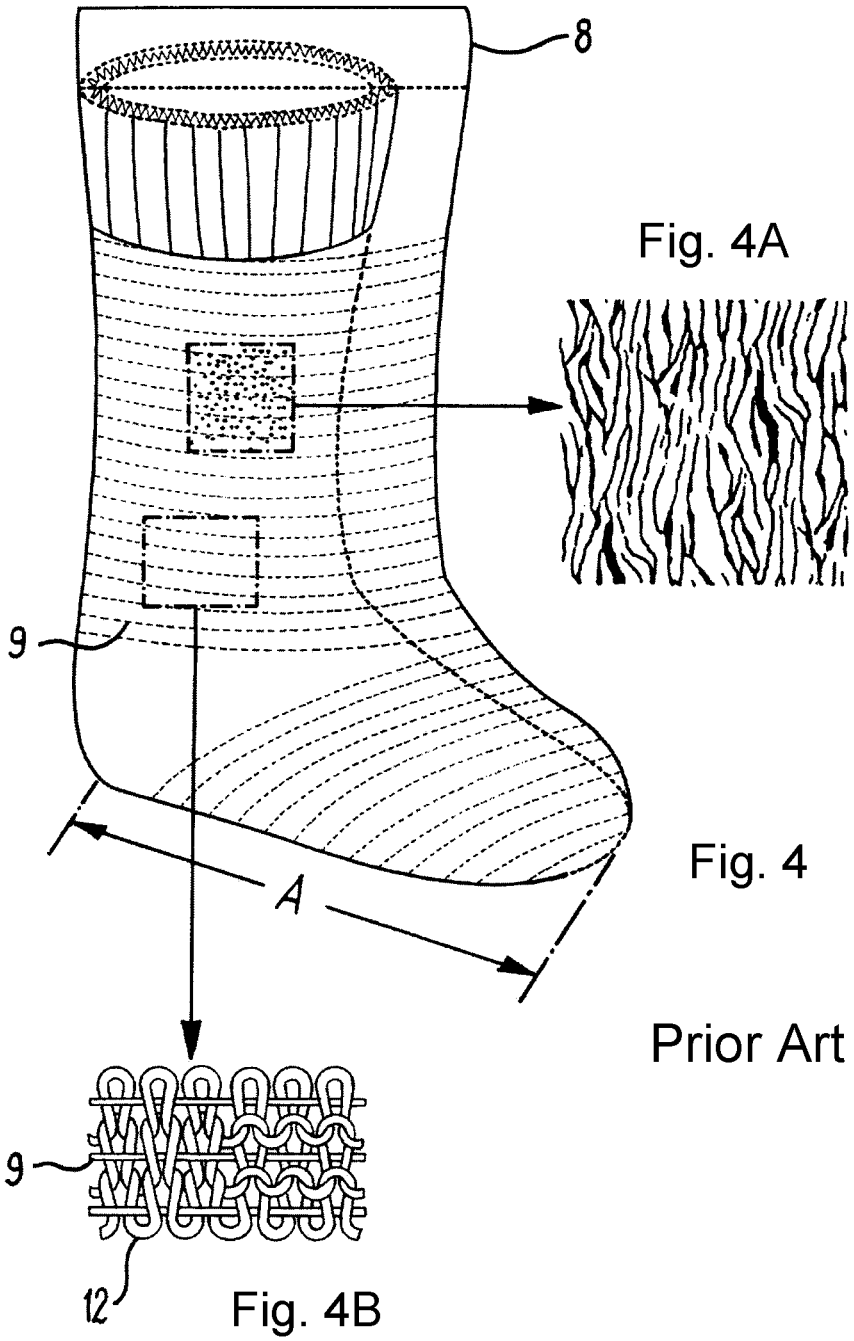
Fig. 4 Prior Art
FIG. 4 is a schematic diagram of a waterproof composite sock using a sock component with circumferentially lay in elastic threads.
FIG. 4A is an illustration diagram for the corrugated texture of the intermediate film in longitudinal direction for the sock construction illustrated in FIG. 4.
FIG. 4B is a schematic diagram to illustrate the circumferentially laid in elastic threads displayed along the weft courses of the main body in its sock component for the sock construction illustrated in FIG. 4.

The following reference numerals when used herein refer to the following components:

1, Laminated fabric;
2, Seam taping on stitching line;
3, outer sock layer;
4, intermediate waterproof breathable film;
5, inner sock layer;
6, forming mould;
7, adhesive dot for discrete securement;
8, former used in prior technology;
9, circumferentially extending elastic thread;
10, one-step heat press forming mould disclosed in the present invention;
11, fine twisted elastic yarns;
12, main body yarns;
13, cuff band extended from the outer sock; and
14, in-cuff water block kit round sewed inside the cuff band.

DESCRIPTION OF PREFERRED EMBODIMENTS

Embodiment 1

Figure 5:
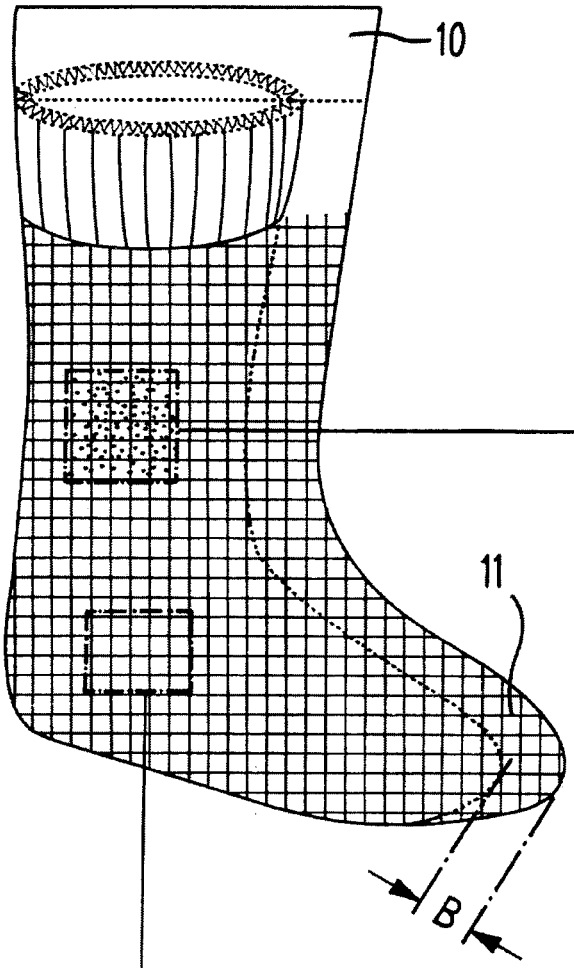
FIG. 5 is a schematic diagram of the waterproof composite sock with two-way extensible properties disclosed by the present invention.
Figure 5A:
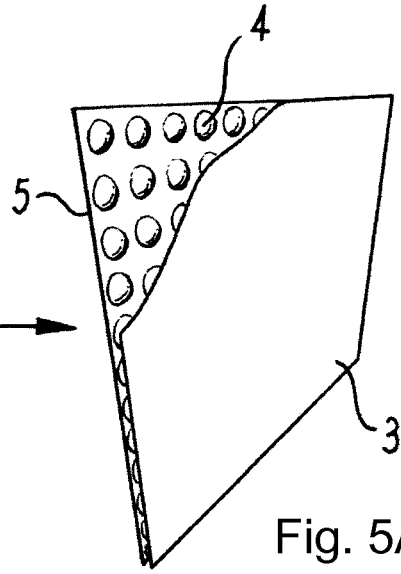
FIG. 5A is a cross sectional view of the wave structure corrugated in both X and Y directions for the intermediate film for a composite sock as disclosed herein and shown in FIG. 5.
Figure 5B:
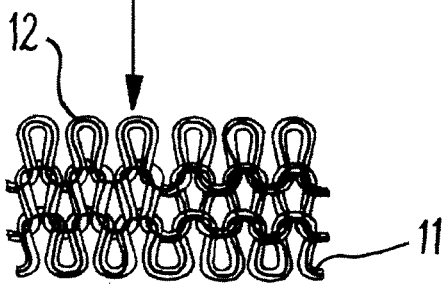
FIG. 5B is a schematic diagram to illustrate the consistent combination of the twisted elastic yarns with the main body yarns for the composite sock in FIG. 5.

A waterproof breathable composite sock with two-way extensible properties, as shown in FIG. 5, is disclosed. The sock is formed by lamination of an outer layer 3, an inner layer 5 and an intermediate waterproof and breathable film 4 on a one-step forming mould 10. The inner and outer layers 5 and 3 are bonded to the intermediate film 4 by discrete hot melt adhesive dots 7, wherein the outer layer 3, or both the outer 3 and inner 5 layers, is/are knitted by deploying fine twisted elastic yarns 11 consistently into main body yarns 12, as shown in FIG. 5B. The twisted elastic yarns 11 in this composition have excellent elasticity to make the sock layer(s) very stretchable. In preferred embodiments, the elastic yarns are made of spandex. The waterproof breathable film 4, which is made up in sock shape in advance, is at the same size as the sock-like forming mould 10, but at a larger size than the relaxed size of the outer sock layer 3 and the inner sock layer 5. By this composition and configuration, the film component 4 sandwiched in between the outer sock layer 3 and the inner sock layer 5 shrinks under the tension of the sock layers and has an internal puckered structure in both X and Y directions (like a wave texture) after lamination to the opposing layers 3 and 5 and removal of the resulting composite sock structure from the mould 10, as illustrated in FIG. 5A. The resulting composite sock therefore is extensible both circumferentially and longitudinally. The waterproof composite socks made by this technology have two-way stretchable properties in particular in sock length (longitude) direction, resulting in a large range of flexibility to accommodate a variety of foot sizes for a single sock size. The flexibility offers the wearer a stretchable, comfortable and form-fitting fit and eliminates the possibility of scrubbing the waterproof film at the toe part during the tough sports, which can result in water leakage. Also by this construction, the outer sock layer 3 can be knitted in tighter courses so it also eliminates the possible problem that the intermediate film 4 might show through between the knitting courses of the sock layer 3, as sometimes happened for composite socks with heavily laid in elastic threads. The 'show through' problem can easily damage the performance barrier particularly during tough outdoor sports activities.

Embodiment 2

As shown in FIG. 5B, the twisted elastic yarns, which are knitted with the main body yarns and are consistently deployed in all the knitting courses, provide recovery tension in all directions, including both lateral and longitudinal, for the composite sock. The elastic yarns are preferably 350 twists per meter and the ratio of the main body yarns to the twisted elastic yarns is preferably 75:25. The adhesive system used for lamination of the outer layer 3, the inner layer 5, and the intermediate waterproof breathable film 4 is preferably hot melt TPU material spread on the interior and exterior surfaces of the film 4 in discrete dotting or powder techniques. The sock outer layer 3, or both the sock outer layer 3 and the inner layer 5, is/are knitted on a single-cylinder 4 inches jacquard hosiery machine. By said construction, the finished composite sock obtains the best elastic modulus in both circumferential and longitudinal directions. In addition, by using said hosiery machine and the disclosed yarn combination, the present technology can make the composite sock in a complex jacquard design, which is theoretically difficult to be knitted in the prior technology due to the heavily laid in elastic threads in the outer layer 3.

Embodiment 3

Figure 6:
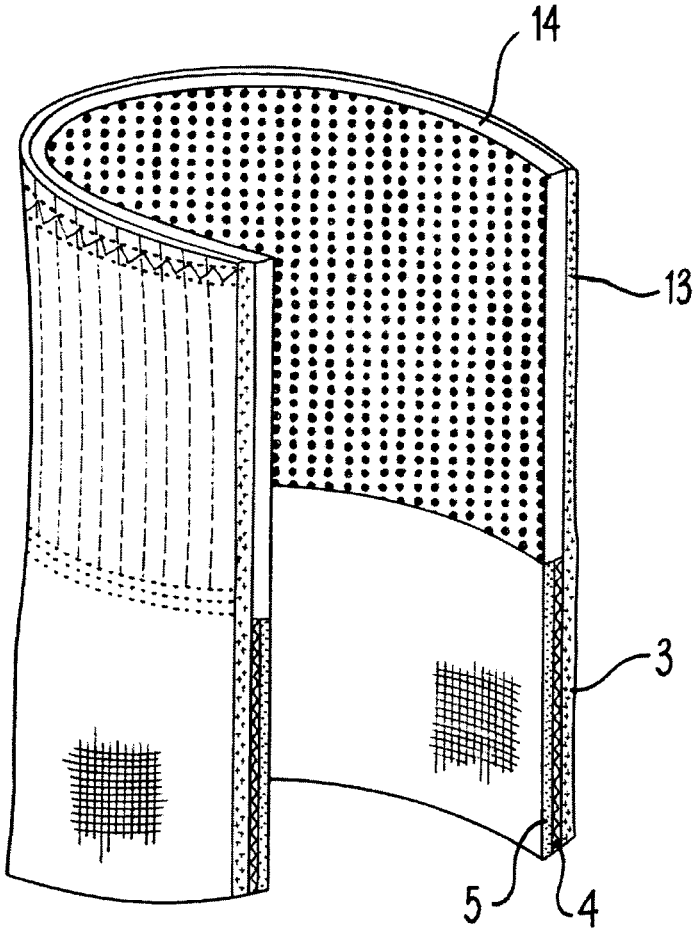
FIG. 6 is a cross sectional view of the in-cuff seal kit disclosed in the present invention.

As shown in FIG. 6, a composite sock made by the present invention can be made with an in-cuff water block seal, wherein the cuff band 13 is extended upwards from the outer layer 3, and the in-cuff seal kit 14 is constructed of two-way stretchable waterproof polyurethane fabric sewed around inside the cuff band. The waterproof PU elastic fabric preferably is of the type of modern material developed for high quality swimwear and has excellent all way elasticity. The elastic fabric sewn with the cuff of the knit sock provides a comfortable but tight (preferably leak-tight) seal over the leg calf, and therefore stops water from coming into the composite sock over the top.

Embodiment 4

On the basis of the above waterproof composite sock, the height of round fabric 14 should be equal to or more than 2 cm. By internal experiments, when the waterproof sock with the in-cuff seal kit illustrated above was in use, and when water splashed onto the top of the sock, the water block kit could effectively stop the water entering in only when the height of the water block material exceeded a certain value. On the other hand, the wearer felt uncomfortable if the waterproof fabric kit was too high. A height of 5 cm was found to provide an optimal combination of water blocking and wearer comfort as per the test results.

The composite sock made by the invention is waterproof and breathable, whilst being comfortable and exhibiting two-way stretchable properties. In preferred embodiments, the composite sock disclosed herein also exhibits in-cuff water block function as described above. The invention provides a way to make waterproof composite socks that have improved comfort for the wearer in real experience, and also a practical method to increase the productivity of the composite socks by using a smaller forming mould that can accommodate a hand-assembly process for making composite socks.

While this document discloses several example embodiments, the invention is not limited to the embodiments herein disclosed. Persons of ordinary skill in related fields can modify and/or alter the embodiments disclosed herein without undue experimentation, and without departing from the spirit and the scope of the invention as set forth in the appended claims.

The invention claimed is:

1. A composite waterproof breathable sock with two-way extensible properties comprising a toe part at a first end, an opening at a second end, an outer layer, an inner layer, and an intermediate waterproof and breathable film, wherein both the outer layer and the inner layer are knitted by deploying twisted elastic yarns consistently into all knitting courses of a main body of each of the inner layer and the outer layer, said twisted elastic yarns being knitted with yarns of the main body of each of the inner layer and the outer layer, the outer layer knitted in tighter courses than the inner layer and comprising a cuff band adjacent to the second end and defining the opening, the cuff band surrounding a water seal and extending a length from the second end toward the first end, the water seal extending the length of the cuff band, the inner layer and the intermediate waterproof and breathable film both abutting and extending from an end of the water seal opposite said opening and toward the first end.

2. The composite waterproof breathable sock according to claim 1, wherein the twisted elastic yarns exhibit 350 twists per meter.

3. The composite waterproof breathable sock according to claim 1, wherein one or both of the outer and inner layers is/are knitted on a single-cylinder 4.0 inches jacquard hosiery machine.

4. The composite waterproof breathable sock according to claim 1, wherein adhesives are used to join the outer layer, the inner layer, and the intermediate waterproof breathable film, wherein the adhesives are heat activated thermoplastic polyurethane (TPU) materials.

5. The composite waterproof breathable sock according to claim 1, wherein the intermediate waterproof and breathable film has a corrugated structure in both weft X and warp Y directions and is configured to be stretched circumferentially and longitudinally.

6. The composite waterproof breathable sock according to claim 1, wherein the water seal is constructed of a two way stretchable waterproof polyurethane (PU) elastic fabric.

7. The composite waterproof breathable sock according to claim 6, wherein the two-way stretchable waterproof polyurethane (PU) elastic fabric is sewn round the inside of the cuff band.

8. The composite waterproof breathable sock according to claim 6, wherein a height along a sock length of said two way stretchable waterproof polyurethane (PU) elastic fabric is equal to or longer than 2 cm.

9. The composite waterproof breathable sock according to claim 6, wherein a height along a sock length of said two way stretchable waterproof polyurethane (PU) elastic fabric is 5 cm.

* * * * *